US005896834A

United States Patent [19]

Grüner

[11] Patent Number: 5,896,834

[45] Date of Patent: Apr. 27, 1999

[54] HEAT TRANSFER ARRANGEMENT AND METHOD OF MAKING SAME

[75] Inventor: Andreas Grüner, Göppingen, Germany

[73] Assignee: Behr GmbH & Co., Stuttgart, Germany

[21] Appl. No.: 08/996,206

[22] Filed: Dec. 22, 1997

[30] Foreign Application Priority Data

Dec. 24, 1996 [DE] Germany ..... 196 54 362

[51] Int. Cl.[6] ..... F01P 11/08

[52] U.S. Cl. ..... 123/41.33; 123/196 AB; 165/140; 165/916

[58] Field of Search ..... 123/41.33, 196 AB; 165/41, 140, 167, 916

[56] References Cited

U.S. PATENT DOCUMENTS

| | | | |
|---|---|---|---|
| 4,423,708 | 1/1984 | Sweetland | 123/196 AB |
| 5,409,058 | 4/1995 | Yuasa et al. | 165/140 |

FOREIGN PATENT DOCUMENTS

| | | |
|---|---|---|
| PS685914 | 1/1940 | Germany . |
| 2232990 | 1/1973 | Germany . |
| 3248395A1 | 7/1983 | Germany . |
| 4125079A1 | 2/1992 | Germany . |
| 4403144A1 | 8/1995 | Germany . |
| 19519740A1 | 12/1996 | Germany . |
| WO96/38699 | 12/1996 | WIPO . |

OTHER PUBLICATIONS

Patent Abstracts of Japan, 07224660A, ublished Aug. 22, 1995, Oil Air–Cooling System of Air–Cooled Engine.

*Primary Examiner*—Noah P. Kamen

*Attorney, Agent, or Firm*—Evenson, McKeown, Edwards & Lenahan, PLLC

[57] ABSTRACT

In heat transfer devices, which are constructed as plate oil coolers for motor vehicles, an adapter plate is provided in order to achieve a compact construction with a joint fastening and with feeding openings which are accessible only from one side. The adapter plate is configured such that at least two, but preferably four different plate coolers can be supplied with the same coolant flow. This results in a particularly simple and compact construction.

17 Claims, 3 Drawing Sheets

FIG.1
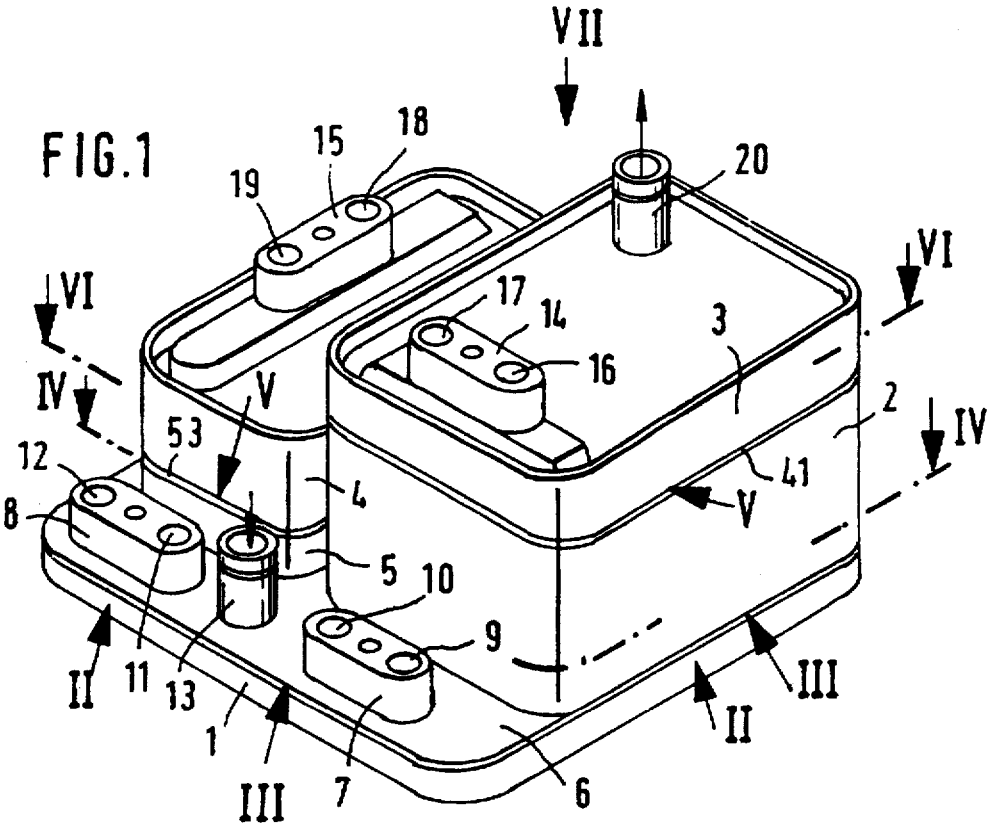
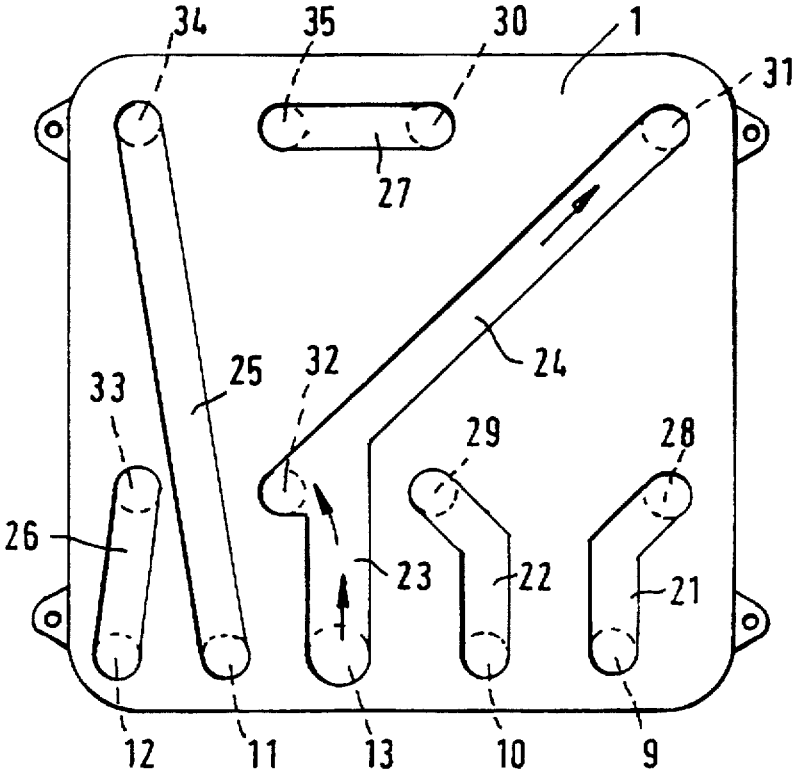
FIG.2

HEAT TRANSFER ARRANGEMENT AND METHOD OF MAKING SAME

BACKGROUND AND SUMMARY OF THE INVENTION

This application claims the priority of German application 196 54 362.2 filed in Germany Dec. 24, 1996, the disclosure of which is expressly incorporated by reference herein.

This invention relates to a heat transfer arrangement such as an oil cooler arrangement for motor vehicles having at least one heat transfer device. A liquid coolant and a liquid medium to be cooled are guided in the at least one heat transfer device in adjacent layers which are separated from one another by heat transmitting walls. An adapter plate is assigned to the heat transfer device, and connection ducts are provided between feeding and discharge bores for the heat transfer device.

Such a heat transfer device is known from German Patent Document DE-GBM 93 09 741. In this device, an adapter plate is assigned to the underside of a cooler constructed of plate-shaped heat exchange elements, as it is used in practice for cooling oil. This adapter plate is connected with a fastening plate which, on one side, closes off the adapter plate. The adapter plate is provided with recesses for forming a duct and with a feeding opening for the coolant. As a result, the heat transfer device can be fastened as a unit. As a result, inflow and discharge can simultaneously take place by way of the fastening plate from below.

There are a number of application possibilities in which several coolers must be provided for additional assemblies, such as an engine oil cooler, a servo oil cooler or a cooler for the transmission oil or for diesel oil. These additional assemblies must all be housed individually at a suitable point. This requires high expenditures and, moreover, sufficient space is not always available for housing the individual cooler aggregates.

The present invention is therefore based on the object of developing a heat transfer arrangement of the initially mentioned type such that several coolers can be combined to form a unit without any separate expenditures for the feeding of the coolant.

Based on the idea of using an adapter plate, the invention for achieving this object closes off the adapter plate by a cover plate. The cover plate is provided with a joint connection piece for the coolant, a connection duct and an opening for transporting the coolant. Two additional connections are provided for feeding and discharge of one medium respectively to be cooled of two heat transfer devices. These two heat transfer devices are arranged side-by-side on the cover plate and are connected to the joint connection piece for the coolant.

Because of this development, two or more heat transfer devices can be connected by way of a joint coolant connection and can jointly be fastened by the adapter plate. As a further development of the invention, coolant can flow in parallel through both heat transfer devices, and connection ducts for the coolant can rest on a joint end connection piece assigned to one of the two heat transfer devices.

According to certain preferred embodiments, it was found to be expedient to design one of two heat transfer devices for cooling the engine oil and the other for cooling the oil for the power steering. The reason for this is that these two coolers virtually represent the basic equipment for vehicles of different types and powers.

As a further development of the invention, heat transfer devices for cooling additional media, and particularly for cooling transmission oil and diesel oil, can be placed on the block of the engine cooler and/or of the servo oil cooler. Connections for the coolant are aligned with those of the blocks of the other two coolers and with those of the cover plate. In this manner, a compact assembly of different coolers which all have a common coolant connection and discharge can be achieved. The discharge connection piece for the coolant can be assigned to the engine oil cooler or to the diesel oil cooler placed upon the engine oil cooler. The invention achieves a heat transfer arrangement which can be individually adapted to the requirements of different vehicle types. However, since the arrangement has only an adapter plate as the fastening element and has an extremely compact construction, it can be installed in a simple and space-saving manner. In this case, the already existing coolant connection and discharge can be used for each of the coolers.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective representation of a heat transfer arrangement constructed according to a preferred embodiment of the invention;

FIG. 2 is a top view of the adapter plate used for the arrangement of FIG. 1;

DETAILED DESCRIPTION OF THE DRAWINGS

Figure 3:
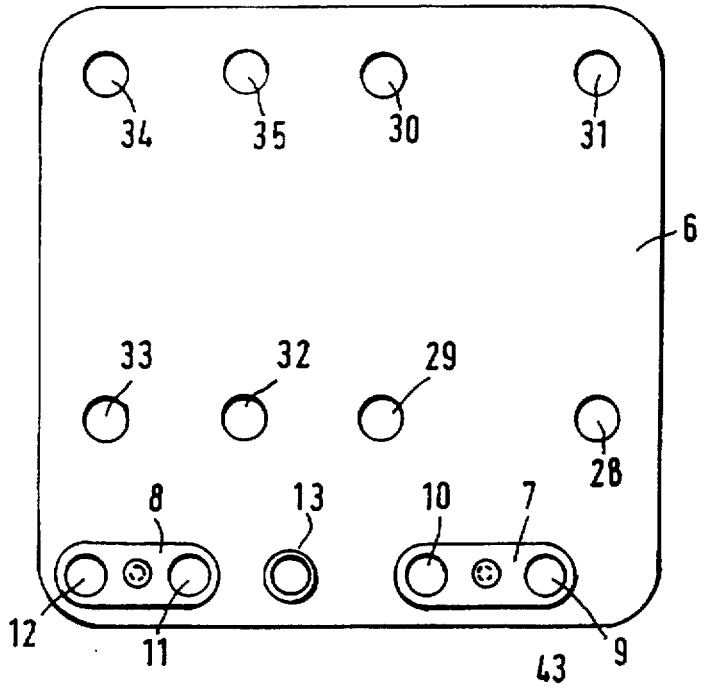
FIG. 3 is a top view of the cover plate disposed on the adapter plate of the arrangement of FIG. 1.

FIG. 1 illustrates a heat exchanger arrangement according to the invention which comprises an adapter plate 1 and heat transfer devices 2, 3, 4 and 5 fixedly connected with it. The adapter plate 1 is covered by a cover plate on which the two heat transfer devices 2 and 5 are mounted. In this case, the adapter plate 1 and the cover plate 6 are slightly larger than the base surface of the heat transfer devices 2 and 5. Two connection pieces 7 and 8 with connections 9, 10 and 11, 12 respectively are provided on the area of the cover plate 6 which in FIG. 1 is toward the left front. A connection piece 13 is also provided between these two connection pieces 7 and 8 and is used as- a joint feeding connection piece for the coolant flowing through the heat transfer devices 2, 3, 4 and 5. The connections 9 and 10 of the connection piece 7 are used for admitting the medium to be cooled to the heat transfer device 2. In the embodiment shown, this medium is engine oil. The connection openings 11 and 12 are used for supplying the oil for power steering, and forms the so-called servo oil. Each of the two heat transfer devices 3 and 4 is placed on top and is again designed with a feeding connection piece. The feeding connection piece 14 with the feeding and discharge openings 16, 17 is for diesel oil (heat transfer device 3), and the feeding connection piece with the feeding and discharge openings 18, 19 is for transmission oil (heat transfer device 4). In the embodiment shown, a discharge connection piece 20 projects from. the heat transfer device 3 through which the coolant which is fed through the connection piece 13 flows off again.

The heat transfer devices 2, 3, 4 and 5 are all designed as plate coolers in which the plates, which are stacked upon one another at a defined distance with respect to one another, form flow spaces between one another through which alternately the coolant and the medium to be cooled by.the coolant flow. Flowing and feeding of the two media to the individual chambers take place in a known manner. On the outside, the chambers are closed off by bent and mutually overlapping edges of the stacked plates. All heat transfer devices are tightly soldered.

As illustrated in FIG. 1, the coolant introduced through the inflow connection piece 13 flows through all heat transfer devices 2 to 5, while the medium to be cooled is in each case separately but also from the same side fed to the individual heat transfer devices. The coolant also enters the connection piece 13 from this side. The discharge connection piece 20 also projects toward the same side so that all connections for the media flowing through the heat transfer devices take place from one side. The adapter plate is therefore closed off toward the other side and can be used as a joint fastening plate, as is also illustrated in FIG. 2.

FIG. 2 shows that the adapter plate 1 is provided with several grooves in the form of connection ducts 21 to 27. The connection ducts are all milled into the adapter plate which consists, for example, of an aluminum alloy. It is also contemplated to provide a plastic plate instead of a diecast aluminum plate in accordance with other preferred embodiments of the invention.

This adapter plate 1 is closed off by the cover plate 6 illustrated in FIG. 3 so that the ducts 21 to 27 are also closed. However, these ducts are connected through the cover plate 6 upwards with different connections which will be briefly discussed.

FIG. 3 shows that, in addition to the above-mentioned connection pieces 7, 8 and 13, the cover plate is also provided with openings 28 to 35 which are each aligned with the ends of the ducts 21 to 27 provided in the adapter plate 1. The positions of the openings 28 to 35 are indicated by broken lines in FIG. 2.

Figure 4:
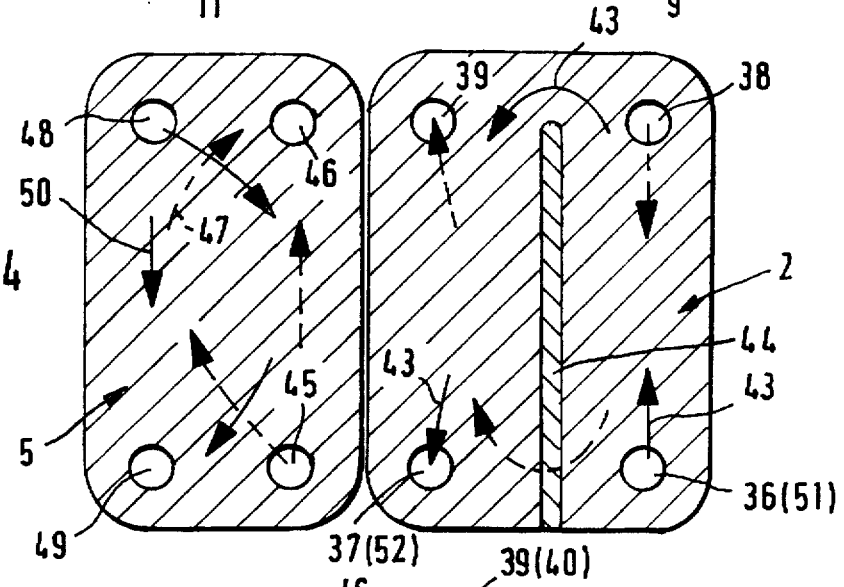
FIG. 4 is a cross-sectional view of the two plate oil coolers for the engine oil and for the power steering oil arranged on the cover plate of the arrangement of FIG. 1.

The coolant such as that which is used also for cooling the engine, therefore, flows through the connection piece 13 into the two ducts 23 and 24 of the adapter plate 1 and is distributed from there to the openings 31 and 32 in the cover plate 6. In the corresponding layer of the heat transfer device 2 placed on the cover plate 6, the coolant then flowsout of the opening 31 and out of the openings 38 aligned with the opening 31 in the direction of the arrows shown by broken lines in FIG. 4. The coolant flows in each chamber of the heat transfer device 2 in a U-shaped manner to the openings 39 aligned with the opening 30 in the cover plate 6. The coolant can travel from there further upwards to the passages 40 and 42 which are aligned with the openings 39. The intermediate plate 41 is disposed between the heat transfer devices 2 and 3, and.the coolant travels from the passage 40 through the opening 42 to the outlet connection piece 20.

The engine oil or other medium to be cooled flows through the opening 9 into the connection piece 7, reaches the duct 21 and the opening 28 in the cover plate 6, and travels from there through the openings 36 in the heat transfer device 2 into the chambers which are adjacent to the layers through which the coolant flows. The coolant is guided in the direction of the arrows 43 through the chambers of the heat transfer device 2, which in a known manner are designed in a U-shape as a result of the partition, to the openings 37 aligned with the opening 29 in the cover plate 6. The medium to be cooled will reach the duct 22 leading to the outlet connection 10 by way of these openings 37. The coolant and the medium to be cooled are therefore guided in mutually offset layers in a manner known as counterflow with respect to one another. The feeding connection piece 13 and the discharge connection piece 20 for the coolant are utilized for the heat transfer device 2, for the heat transfer device 3 arranged thereon, for the heat transfer device 5 for the servo oil for the steering, and for the transmission oil heat transfer device 4 disposed on the heat transfer device 5.

The coolant is guided through the connection 13 and, by way of the duct 23, to the opening 32 in the cover plate 6. The coolant is moved from the opening 32 by way of the openings 45 (see FIG. 4) aligned with the opening 32 in the direction of the arrows 47 indicated by broken lines to the openings 46. The openings 46, in turn, are connected with the opening 35 in the cover plate 6 and, by way of the opening 35 and the duct 27, are connected with the opening 30 in the cover plate 6. The cover plate 6, in turn, is connected with the discharge connection piece 20 as explained above. The flow of the coolant and of the medium to be cooled in the individual layers takes place within the heat transfer device in the same manner as described by means of the heat transfer device 2. The medium to be cooled is supplied through the feeding connection piece 11 and travels within the adapter plate through the duct 25 to the opening 34 of the cover plate 6. The medium travels from the opening 34 to the openings 48 in the heat transfer device 5 and flows in the corresponding layers in the directions of the arrows 50 to the openings 49. The medium is guided from this location by way of the openings 33 in the cover plate 6 into the duct 26 and from there to the outlet connection piece 12. The flow of the coolant in the directions of arrows 47 or of the medium to be cooled in the directions of arrows 50 in each case takes place in adjacent layers of the plate coolers. Therefore, the openings 48 and 45 are in each case open only toward the corresponding chambers in which the flow is desired. Coolant flows through the two heat transfer devices 2 and 5 in the described manner but jointly and in parallel.

The coolant can also be utilized for flowing through two additional heat transfer devices 3 and 4 which are fixedly placed on top of the heat transfer devices 2 and 5.

To utilize the coolant in this way, in each intermediate plate 41 and 53, the connections for the coolant are aligned with those of the heat transfer device situated underneath and with the adapter plate 1. The opening 38 of the intermediate plate 41, therefore, is aligned with the opening having the same number in the heat transfer device 2 and, therefore, with the opening 31 in the cover plate 6. By way of these openings, which again lead into the individual chambers of the heat transfer device 3 disposed on the intermediate plate 41, the coolant can now circulate in the directions of the arrows 47 in the assigned chambers of the heat transfer device 3. This coolant is discharged again through the opening 39 toward the outlet connection piece 20.

Figure 5:
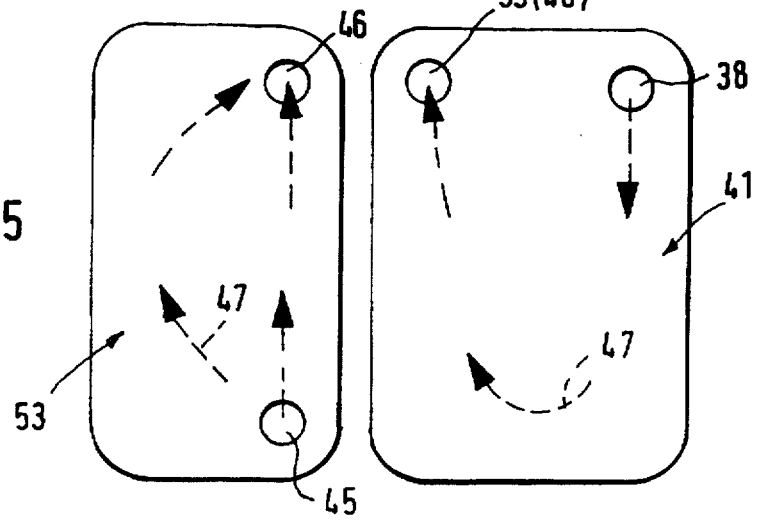
FIG. 5 is a view of the two intermediate plates closing off the two plate oil coolers of the arrangement of FIG. 1.
Figure 6:
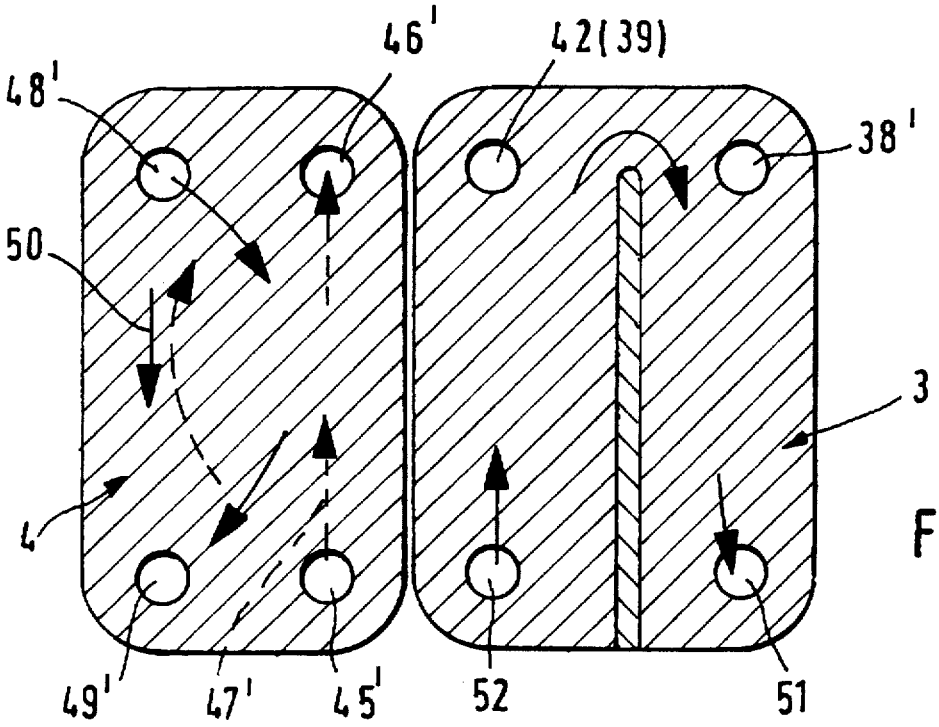
FIG. 6 is a schematic cross-sectional view of the two coolers for diesel oil and for transmission oil placed on top of the arrangement of FIG. 1.
Figure 7:
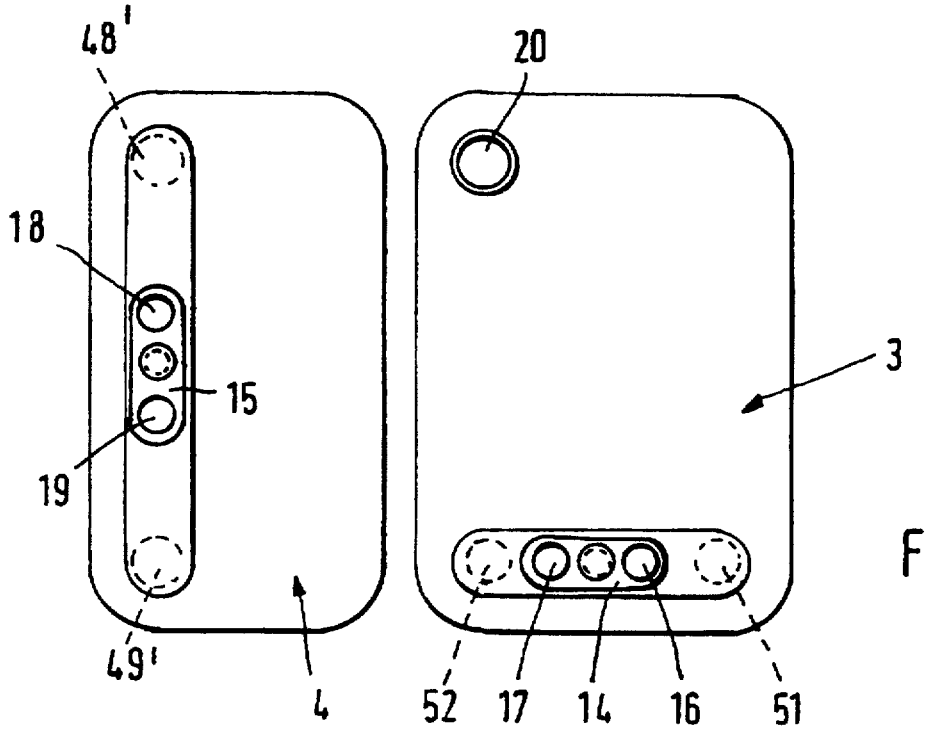
FIG. 7 is a top view of the two end plates for the coolers of the arrangement of FIG. 1.

The same approach takes place with respect to the heat transfer device 4 which is separated by an intermediate plate 53 (FIG. 5) from the heat transfer device 5 situated underneath the heat transfer device. In this case, the opening 45 in the intermediate plate 53 is aligned with the feeding openings 45 and with the opening 32 in the cover plate 6 so that the coolant flows in the direction of the arrows 47 out of the openings 45' through the assigned chambers of the heat transfer device 4. The medium to be cooled, which flows in through the opening 18 of the connection piece 15, is guided by way of the openings 481 in the directions of the arrows 50 in the adjacent chambers to the openings 49. The openings 49, in turn, are connected with the discharge opening 19.

It is also contemplated in other embodiments to place the two heat transfer devices 3 and 4 on the other side of the adapter plate 1 and to let the feeding of the coolant in each case take place at points 31 and 32 in the downward direction if the adapter plate 1 is provided with continuous recesses rather than grooves. However, it would be necessary in this case to carry out the feeding and removal of diesel oil or transmission oil to the connection pieces 14 and 15 from the other side. This is not always simple.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Heat transfer arrangement for motor vehicles, comprising:

first and second heat transfer devices in which a liquid coolant and a liquid medium to be cooled are guided in adjacent layers which are separated from one another by heat transmitting walls, an adapter plate disposed to support the heat transfer devices, said adapter plate defining connection ducts between respective feeding and discharge bores of the first and second heat transfer devices, and a cover plate interposed between the first and second heat transfer devices and the adapter plate, wherein said cover plate includes:

a joint connection piece for conducting coolant through the cover plate into a connection duct of the adapter plate, openings for transporting coolant from the adapter plate to the first and second heat transfer devices, and two additional connections for feeding and removing medium to be cooled in the first and second heat transfer devices supported side by side on the cover plate.

2. Heat transfer arrangement according to claim 1, wherein the adapter plate has a closed bottom and has one side covered by the cover plate.

3. Heat transfer arrangement according to claim 2, and further comprising a joint discharge connection piece for one of said first and second heat transfer devices to which discharge ducts for the coolant are connected by one of said connection ducts.

4. Heat transfer device according to claim 2, wherein the first heat transfer device is designed for the cooling of engine oil and the second heat transfer device is designed for the cooling of oil for power steering.

5. Heat transfer device according to claim 8, and further comprising further heat exchangers for cooling of transmission oil and diesel oil placed on respective blocks of the first heat transfer device and of the second heat transfer device and connections to said further heat exchangers for the coolant.

6. Heat transfer device according to claim 5, and further comprising a discharge connection piece for the coolant on one of the first heat transfer device and the further heat exchanger for cooling of diesel oil which is disposed on the first heat transfer device.

7. Heat transfer arrangement according to claim 1, and further comprising a joint discharge connection piece for one of said first and second heat transfer devices to which discharge ducts for the coolant are connected by one of said connection ducts.

8. Heat transfer device according to claim 7, wherein the first heat transfer device is designed for the cooling of engine oil and the second heat transfer device is designed for the cooling of oil for power steering.

9. Heat transfer device according to claim 8, and further comprising further heat exchangers for cooling of transmission oil and diesel oil placed on respective blocks of the first heat transfer device and of the second heat transfer device and connections to said further heat exchangers for the coolant.

10. Heat transfer device according to claim 9, and further comprising a discharge connection piece for the coolant on one of the first heat transfer device and the further heat exchanger for cooling of diesel oil which is disposed on the first heat transfer device.

11. Heat transfer arrangement according to claim 1, wherein the first heat transfer device is designed for the cooling of engine oil and the second heat transfer device is designed for the cooling of oil for power steering.

12. Heat transfer arrangement according to claim 11, and further comprising further heat exchangers for cooling of transmission oil and diesel oil placed on respective blocks of the first heat transfer device and of the second heat transfer device and connections to said further heat exchangers for the coolant.

13. Heat transfer arrangement according to claim 12, and further comprising a discharge connection piece for the coolant on one of the first heat transfer device and the further heat exchanger for cooling of diesel oil which is disposed on the first heat transfer device.

14. A method of making a heat transfer arrangement for motor vehicles, comprising:

providing first and second heat transfer devices in which a liquid coolant and a liquid medium to be cooled are guided in adjacent layers which are separated from one another by heat transmitting walls, disposing an adapter plate to support the heat transfer devices, said adapter plate defining connection ducts between respective feeding and discharge bores of the first and second heat transfer devices, disposing a cover plate between the first and second heat transfer devices and the adapter plate, wherein said cover plate includes:

a joint connection piece for conducting coolant through the cover plate into a connection duct of the adapter plate, openings for transporting coolant from the adapter plate to the first and second heat transfer devices, and two additional connections for feeding and removing medium to be cooled in the first and second heat transfer devices supported side by side on the cover plate, and fixedly attaching said heat transfer devices, cover plate and adapter plate together to form a multiple heat transfer device unit.

15. A method according to claim 14, wherein the adapter plate has a closed bottom and has one side covered by the cover plate.

16. A method according to according to claim 14, wherein the first heat transfer device is designed for the cooling of engine oil and the second heat transfer device is designed for the cooling of oil for power steering.

17. A method according to claim 16, and further comprising the steps of placing further heat exchangers for cooling of transmission oil and diesel oil on respective blocks of the first heat transfer device and of the second heat transfer device and providing connections to said further heat exchangers for the coolant.

* * * * *